United States Patent [19]

Szekely

[11] 4,040,610

[45] Aug. 9, 1977

[54] APPARATUS FOR REFINING MOLTEN METAL

[75] Inventor: Andrew Geza Szekely, Yorktown Heights, N.Y.

[73] Assignee: Union Carbide Corporation, New York, N.Y.

[21] Appl. No.: 714,669

[22] Filed: Aug. 16, 1976

[51] Int. Cl.[2] ..... C22B 9/00

[52] U.S. Cl. ..... 266/235; 266/285

[58] Field of Search ..... 13/22, 35; 75/65 R, 75/68 R, 93 R, 93 E, 95; 266/200, 215, 235, 275, 280, 281, 285, 286; 264/30

[56] References Cited

U.S. PATENT DOCUMENTS

| | | | |
|---|---|---|---|
| 2,223,617 | 12/1940 | Johnston | 13/22 |
| 2,385,333 | 9/1945 | Clapp et al. | 266/200 |
| 2,393,306 | 1/1946 | Bonsack | 266/200 |
| 2,510,932 | 6/1950 | Poland | 75/68 R |
| 3,655,356 | 4/1972 | Javaux | 266/285 |
| 3,743,263 | 7/1973 | Szekely | 75/68 R |

*Primary Examiner*—Gerald A. Dost
*Attorney, Agent, or Firm*—Saul R. Bresch

[57] ABSTRACT

A vessel adapted for maintaining metal in a molten state comprising, in combination:

a. an insulating refractory shell impervious to molten metal;

b. a lining for a major proportion of that interior surface of said shell, which will be below the surface of the melt, said lining comprising graphite or silicon carbide blocks, which are free to expand in at least one direction in response to the application of heat; and c. at least one heating means disposed within any of the blocks.

9 Claims, 3 Drawing Figures

APPARATUS FOR REFINING MOLTEN METAL

FIELD OF THE INVENTION

This invention relates to apparatus used in metal refining, particularly that associated with refining molten metal.

DESCRIPTION OF THE PRIOR ART

Although the invention described herein has general application in refining molten metals, it is particularly relevant in refining aluminum, magnesium, copper, zinc, tin, lead, and their alloys and is considered to be an improvement over the apparatus described in U.S. Pat. No. 3,870,511 issued Mar. 11, 1975, which is incorporated by reference herein.

Basically, the process carried out in the reference apparatus involves the dispersion of a sparging gas in the form of extremely small gas bubbles throughout a melt. Hydrogen is removed from the melt by desorption into the gas bubbles, while other non-metallic impurities are lifted into a dross layer by flotation. The dispersion of the sparging gas is accomplished by the use of rotating gas distributors, which throw the melt into a highly turbulent state. The turbulence causes the small non-metallic particles to agglomerate into large particle aggregates which are floated to the melt surface by the gas bubbles. This turbulence in the metal also assures thorough mixing of the sparging gas with the melt and keeps the interior of the vessel free from deposits and oxide buildups. Non-metallic impurities floated out of the metal are withdrawn from the system with the dross while the hydrogen desorbed from the metal leaves the system with the spent sparging gas.

The furnace presently used in the commercial application of the process comprises an external heating shell containing electrical heating elements and an inner cast iron shell lined with graphite and silicon carbide plates. Although this furnace apparatus has proved to be satisfactory, it is found to have limitations in certain applications.

One limitation involves the service life of the inner cast iron shell, which must be replaced at regular intervals thus creating a dependence on a foundry. It will be understood that it would be more advantageous if an insulating refractory, one that is castable or of cemented bricks, for example, which has a longer life and is easily repairable, could be used in the place of the cast iron shell, but this is only practical if the erosion inherent in the refractory with the accompanying generation of impurities can be countered. Another limitation is involved with an element of design, i.e., the provision of tap or drain holes for the melt, a requirement of many furnaces where frequent alloy changes are made. The problem arises in that the provision of tap holes for externally heated furnaces is technically unfeasible. Still another limitation is that of providing metal inlet and outlet ports at different locations in the furnace for different customers. In the cast iron shell, the location of these ports is fixed by the casting pattern used by the foundry for casting the iron shell. Changes in the casting pattern are uneconomic because so many different patterns are required. In contrast, the refractory shell can be custom built to meet customer needs.

In order to use an insulating refractory shell, however, external heating means can no longer be used, but, rather, some form of internal heating is needed. The use of immersion heating has been suggested, but suffers from serious liabilities, e.g., the introduction of immersion heaters interferes with the bubble pattern in cases where the metal is sparged with a gas. It also interferes with the free movement or physical state of the melt, particularly the flow of the metal through filter media or the furnace. The use of immersion heaters is also less than satisfactory in an aluminum filtering system since the insertion of the heaters in the filtration medium has to be accommodated initially and on replacement.

A further deficiency in typical immersion heaters is that they cannot withstand an environment of high turbulence for any length of time. This stems from the fact that the heating device of the immersion heater needs a protective shell, which has a high thermal conductivity, is capable of withstanding high temperatures, and is inert to the melt and corrosion resistant. These protective shells are usually thin walled to provide good thermal conduction and for economic reasons, however, they have a relatively short life under exposure to high turbulence. The problem is further aggravated by the manner in which the immersion heaters are suspended in the melt, the suspension by its very nature providing very little support against the forces of agitation to which the immersion heater is exposed.

SUMMARY OF THE INVENTION

An object of this invention, therefore, is to provide apparatus for metal refining which provides an internal heating source while overcoming the drawbacks of the immersion heater, maximizes shell life, minimizes erosion, is easily repairable, and economically accepts tap holes and customizing insofar as metal inlet and outlet ports are concerned.

Other objects and advantages will become apparent hereinafter.

According to the present invention, such apparatus has been discovered in the form of a vessel adapted for maintaining metal in a molten state comprising, in combination;

a. an insulating refractory shell impervious to molten metal;

b. a lining for a major proportion of that interior surface of said shell, which will be below the surface of the melt, said lining comprising graphite or silicon carbide blocks, which are free to expand in at least one direction in response to the application of heat; and c. at least one heating means disposed within any of the blocks.

The described vessel finds a preferred application in apparatus comprising, in combination:

d. the vessel defined above in (a), (b), and (c);

e. at least one rotating gas distributing means disposed in said vessel; and f. inlet and outlet means for molten metal and gases.

DESCRIPTION OF THE PREFERRED EMBODIMENT

Figure 1:
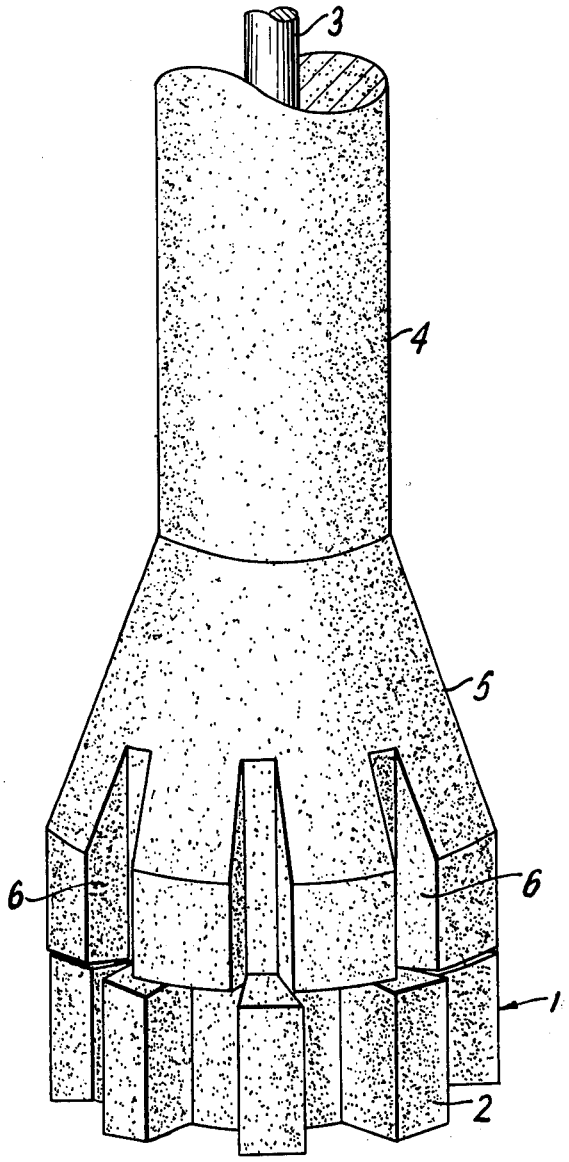
FIG. 1 is a perspective view of a preferred embodiment of rotating gas distributing means as shown in U.S. Pat. No. 3,870,511 referred to above.

The entire structure utilized in melt refining may be referred to as a furnace and is generally comprised of an outer steel shell lined first with an insulating refractory such as a brick cemented with, e.g., an alumina-silica mixture. The first insulating liner is then lined with an impervious refractory liner, which is also an insulator and usually a castable alumina, but can also be cemented brick. Both the first and second refractory linings are made of conventional materials having good insulating properties and of sufficient thickness to keep the heat losses from the furnace at economically acceptable levels. Although the use of the steel shell and first insulating refractory are suggested, the present invention simply requires that an insulating refractory shell impervious to molten metal having a thermal conductivity lower than about 0.5 BTU/square foot/hour/° F/foot be used. These refractories are usually cured prior to use.

This refractory shell is then lined with "blocks" comprised of a high thermal conductivity material, which is inert to the melt and corrosion resistant, and whose surface repels or resists wetting by the melt. The thermal conductivity is at least about 5 BTU/square foot/-hour/° F/foot.

The term blocks is defined herein to mean a prefabricated piece of material that has a specified form. Common forms of blocks are conventional, e.g., plates and blocks which are often in the form of rectangular prisms, the difference between the plate and block usually being a matter of thickness. These blocks are equipped with holes, recesses, or the like needed for their installation or function. The blocks (as defined) are preferably graphite or silicon carbide blocks or both. A major proportion or more than 50 percent of the interior surface of the shell is covered with these blocks. The interior surface with which we are concerned here is that which will be below the level of the melt under operating conditions. Preferably, more than about 75 percent of the interior surface is covered with these blocks. In a rectangular prism-shaped structure having one compartment usually the bottom and at least three sides are covered. In such a structure having, e.g., a working compartment where there is turbulence and an exit compartment where there is no turbulence, usually the bottom and at least two sides of the working compartment are covered and a wall is used to separate the exit compartment from the working compartment, the exit compartment being unlined or lined. It is understood that the separating wall is not considered to be part of the lining. Other characteristics of the blocks are (a) relatively low thermal expansion coefficients; (b) a ratio of thermal conductivity to the thermal expansion coefficient larger than $3.10^6$ (room temperature values expressed in units of BTU/square foot/hour/° F/foot and inch/inch/° F, respectively); and (c) resistant to erosion by agitated molten metal.

It will be understood that the materials used for the interior surface or lining above the level of the melt is not critical here, but inert and corrosion resistant materials should at least be considered in view of the exposure to spray from the melt.

One function of the blocks is to protect the refractory shell against erosion caused by the melt and, to this end, the greater the interior surface that is covered the better. Usually, the interior surface of the refractory shell is only exposed because of design limitations.

The blocks are installed in such a manner that their thermal movement is unrestricted in at least one direction and usually two directions. They may be attached to the interior surface of the shell or to each other at one point or another. The melt may penetrate between and behind the blocks, but is minimized as design permits. Any restriction placed on the thermal expansion of the blocks is again due to overriding design limitations, e.g., to keep size to a minimum. The blocks are kept in place by some conventional restraining device or medium, e.g., the shell itself, slots or recesses into which the block can be slipped, or one block can restrain another.

The blocks are of varying thickness depending on their function in the furnace. Two kinds of blocks are utilized here. The function of one kind of block is merely to protect the interior surface of the refractory from erosion. The thickness of this protective block is generally about 1 to about 5 inches. The second kind has a dual function, one, that of the protective block, and, the other function, that of housing an electric heating element or elements or flame heating devices. The thickness of the dual function block is generally about 3 to about 10 inches. The dual function block contains at least one heating device and usually several, e.g., 2 to 4, especially where it covers the interior surface of one of the walls of the furnace. It should be noted that one or several blocks can be used to cover a particular surface restrained as noted above.

A sufficient number of heating devices is provided to maintain the metal in the molten state. This number is related to the intensity of the heating device, e.g., the energy supplied by the flame or per one electric heating element; to the melt volume; and to the heat losses from the outside of the furnace. In applications where metal is flowing through the furnace and it is desired to increase the temperature of the molten metal, the metal flow rate and the intended heating rate define the total power input to the furnace, and in turn, the sizing of the heating devices and blocks. The number of heating devices may range from 1 to 6 or more.

In the case of graphite, the heating device is an electric resistance heating element housed in such a manner that it does not contact the plate. The heating device used in silicon carbide plates, however, can be the same as for graphite or a flame heating device using conventional gas fuels.

The heating element can be a nickel-chromium element or any conventional resistance heating element which can provide temperatures sufficient to maintain the particular metal or alloy in the molten state, e.g., temperatures of about 1000° F to about 2500° F.

Referring to the drawing:

FIG. 1 exemplifies preferred rotating gas distributing means. It can also be referred to as a gas injection device. The device is comprised of rotor 1 equipped with vertical vanes 2. The rotor is rotated by means of a motor (not shown) through shaft 3. Shaft 3 is shielded from the melt by sleeve 4 which is fixedly attached to stator 5. The internal design of the device is such that gas can be introduced into the interior of the device and forced out between stator 5 and rotor 1. The stator has channels 6, which correspond to vanes 2 of the rotor. The simultaneous gas injection and rotor rotation at sufficient pressure and rotation speed cause the desired dispersion pattern of sparging gas in melt creating an environment of high turbulence. Specifics of the device and the circulation pattern may be obtained from U.S. Pat. No. 3,870,511.

Figure 2:
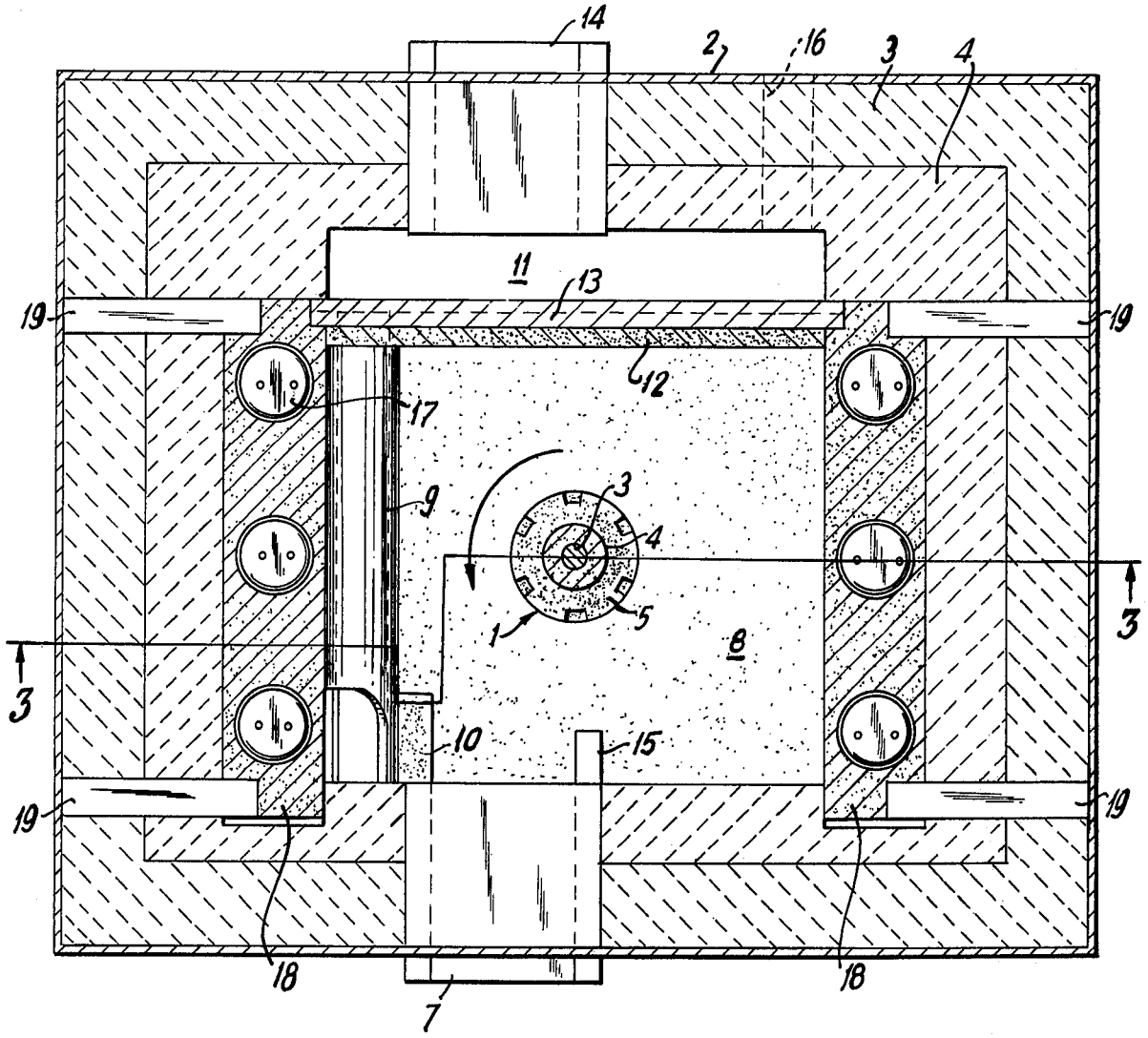
FIG. 2 is a schematic diagram of a plan view showing a preferred embodiment of the apparatus including the defined vessel and single rotating gas distributing means.
Figure 3:
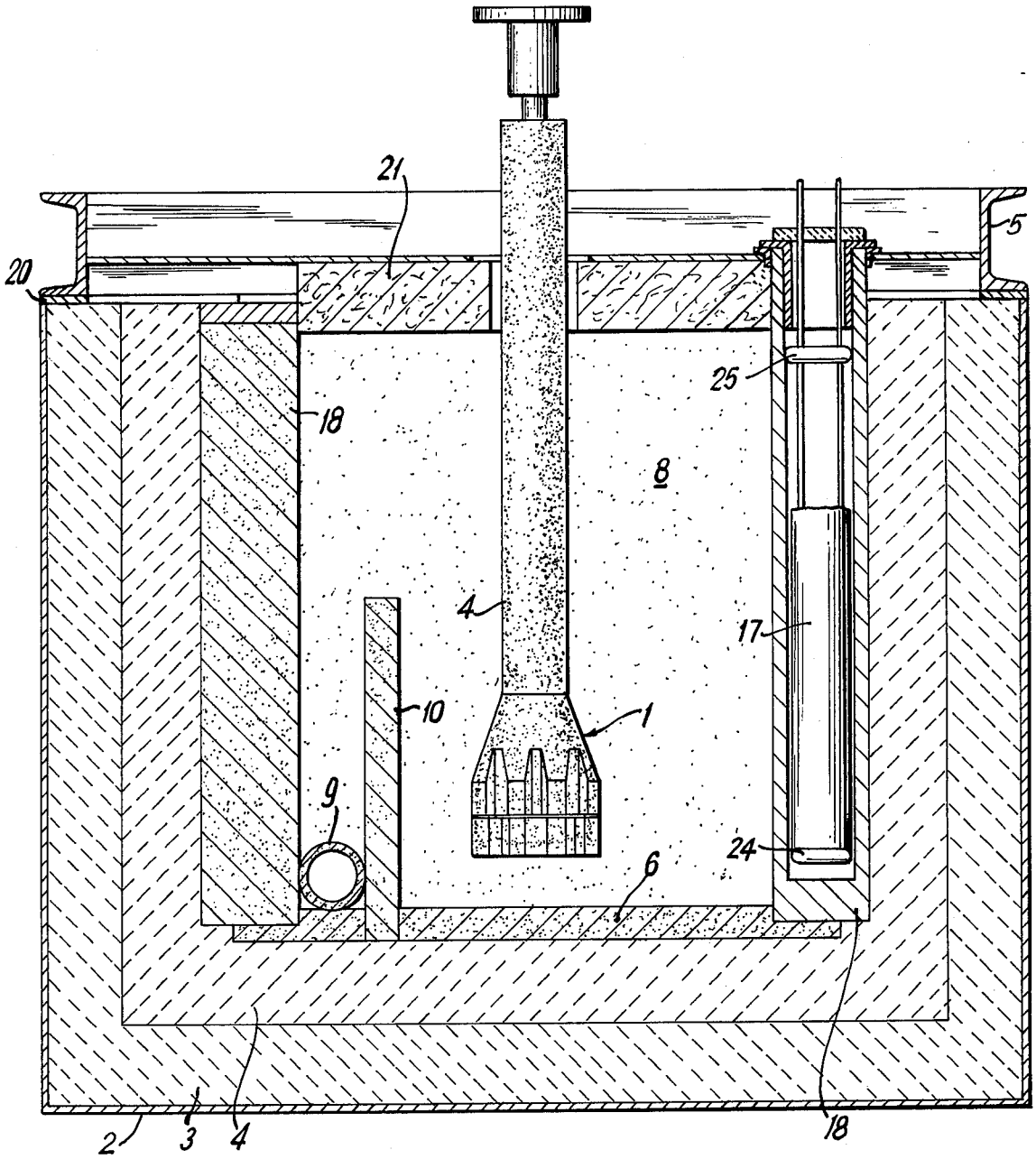
FIG. 3 is a schematic diagram in cross-section taken along 3—3 of the embodiment shown in FIG. 2.

The apparatus shown in FIGS. 2 and 3 has a single rotating gas distributing means 1 which is similar to the device shown in FIG. 1. Outer wall 2 of the furnace is typically made of steel. Inside of wall 2 is refractory 3 of low thermal conductivity cemented brick as a first insulator and inside refractory 3 is refractory 4, a castable alumina impervious to the melt. A typical castable alumina is 96% $Al_2O_3$, 0.2% $Fe_2O_3$, and balance other materials. Refractory 4 is also of low thermal conductivity and, of course, provides further insulation. The outer structure is completed with furnace cover or roof 5 and a superstructure (not shown), which supports gas distributor 1 and an electric motor (not shown).

Since the preferred embodiment uses graphite materials extensively and is intended for a high purity refining operation, it will be understood that the system is adequately sealed and protected by a blanket of inert gas to provide an essentially air-free environment. Where the vessel is so sealed, it will be referred as a "closed" vessel. There are metal refining operations and other instances, e.g., a melt holding situation, where such an environment is not required. Silicon carbide can, of course, be used in both cases. In the latter case, however, air-tight seals and a protective covering of inert gas can be dispensed with. It is contemplated that the vessel proposed here be used in either type of operation and any structure of the described apparatus outside of the defined vessel which is not of value in the latter operation can be omitted for economic reasons or otherwise as the operator sees fit.

The refining operation begins with the opening of sliding doors (not shown) at the entrance of inlet port 7. The molten metal enters working compartment 8 (shown with melt) through inlet port 7 which may be lined with silicon carbide blocks. The melt is vigorously stirred and sparged with refining gas through rotating gas distributor 1. The rotation of the rotor of distributor 1 is counterclockwise; however, the circulation pattern induced in the melt by distributor 1 has a vertical component. Vortex formation is reduced by offsetting the symmetry of working compartment 8 with exit pipe 9 and baffles 10 and 15.

The refined metal enters exit pipe 9 located behind baffle 10 and is conducted into exit compartment 11. Compartment 11 is separated from working compartment 8 by graphite block 12 and silicon carbide block 13. The refined metal leaves the furnace through exit port 14 and is conducted, for example, to a casting machine under a level flow. The bottom of the furnace is lined with graphite plate 6.

The dross floating on the metal is caught by block 15 acting as both a baffle and a skimmer and collects on the surface of the melt close to inlet port 7 from where it can easily be removed. The spent sparging gas leaves the system beneath the sliding doors (not shown) at the entrance. Head space protection over the melt is provided by introducing an inert gas such as argon into the furnace through an inlet pipe (not shown). The atmosphere in exit compartment 11, however, is not controlled and, therefore, graphite block 12 is used there only below the surface of the melt.

A feature of this invention is the avoidance of turbulence in exit compartment 11, i.e. the melt in that section is in an almost quiescent state, which is advantageous in providing a level flow to casting. This is achieved by exit pipe 9 which dampens the turbulence.

Tap or drain hole 16 is provided for draining the furnace when alloy changes are made. It can be located on the inlet or outlet side of the furnace.

Heat is supplied to the furnace, in this embodiment, by six nickel-chromium electric resistance heating elements 17 which are inserted into dual function graphite blocks 18, three in each block. Blocks 18 are kept in place by steel clips 19 and by blocks 12 and 13, which, in turn, are retained by the use of slots and recesses (not shown). Blocks 18 are free to expand toward the inlet side of the furnace and upward.

Roof 5 is in a sealed relationship with the rest of the furnace through the use of flange gasket 20 and is protected from the heat by several layers of insulation 21. An example of the kind of insulation used is aluminum foil backed fibrous aluminum silicate. A bath thermocouple is provided with a protection tube (not shown). Gas distributor 1 and the motor (not shown) are connected to and supported by a superstructure (not shown).

Each heating element 17 is slidably attached to roof 5 so that it can move as dual function block 18 expands, still another feature of this invention. Element 17 is inserted in a hole drilled in block 18. Contact between element 17 and block 18 is prevented by spacer 24 and heat baffle 25. Provision for slidable attachment is made to accommodate the thermal expansion of dual function block 18. The particular attachment is conventional and is not shown. When the furnace is brought up to operating temperature and block 18 has expanded element 17 is then fixed in position. When the furnace is cooled down for any reason, element 17 attachment (not shown) to roof 5 is loosened so that it can move freely with the contraction of block 18. Elements 17 are usually perpendicular to the roof and bottom of the furnace and parallel to each other.

It is preferred that the material used for distributor 1, the various plates and other pieces is graphite. Where any graphite is above the level of the melt, however, it is suggested that the graphite be coated with, e.g., a ceramic paint, or that other protection is provided against oxidation even though seals and a protective atmosphere are utilized or silicon carbide can be substituted for the graphite.

A motor, temperature control, transformer, and other conventional equipment (all not shown) are provided to drive distributor 1 and operate heating elements 17. Sealing of inlet and outlet ports, piping, and other equipment to protect the integrity of a closed system is also conventional and not shown.

I claim:

1. A vessel adapted for maintaining metal in a molten state comprising, in combination:

a. an insulating refractory shell having side walls and a bottom wall and being impervious to molten metal.

b. a lining for a major proportion of that interior surface of said side walls and bottom wall, which surface will be below the surface of the melt, said lining comprising graphite or silicon carbide blocks, which blocks (i) are positioned so that said blocks will come in contact with the melt, and (ii) are free to expand in at least two directions in response to the application of heat; and c. at least one electric resistance heating element disposed within any of the blocks, which comprise the lining for a side wall, said element being non-fixedly attached to, and not in electrical contact with, the block within which it is disposed.

2. Apparatus for refining molten metal comprising, in combination:

a. the vessel defined in claim 1;

b. at least one rotating gas distributing means disposed in said vessel; and c. inlet and outlet means for molten metal and gases.

3. The apparatus defined in claim 2 having one rotating gas distributing means.

4. The apparatus defined in claim 2 wherein the vessel is closed.

5. The apparatus defined in claim 3 wherein the vessel is closed.

6. The apparatus defined in claim 3 wherein the vessel has a working compartment and an exit compartment, and the working compartment is connected to the exit compartment in such a manner that turbulent melt flowing from the working compartment to the exit compartment will be dampened to an essentially quiescent state.

7. The apparatus defined in claim 5 wherein the blocks are graphite.

8. The apparatus defined in claim 7 wherein the vessel has a roof and the heating element is slidably attached to the roof in such a manner that it moves on expansion of contraction of the block within which it is disposed.

9. The apparatus defined in claim 4 wherein the blocks are graphite.

* * * * *

UNITED STATES PATENT OFFICE

CERTIFICATE OF CORRECTION

Patent No. 4,040,610 Dated August 9, 1977

Inventor(s) Andrew Geza Szekely

It is certified that error appears in the above-identified patent and that said Letters Patent are hereby corrected as shown below:

Column 8, line 11, change "of" to --or--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*